US006345648B1

(12) United States Patent
Cheung

(10) Patent No.: US 6,345,648 B1
(45) Date of Patent: Feb. 12, 2002

(54) GRIPPER PLUG FOR HAND STRAPPING TOOL

(75) Inventor: Nelson Cheung, Hoffman Estates, IL (US)

(73) Assignee: Illinois Toole Works Inc., Glenview, IL (US)

( * ) Notice: Subject to any disclaimer, the term of this patent is extended or adjusted under 35 U.S.C. 154(b) by 0 days.

(21) Appl. No.: 09/688,433

(22) Filed: Oct. 16, 2000

(51) Int. Cl.[7] ..... B21F 9/00
(52) U.S. Cl. ..... 140/93.2; 254/216
(58) Field of Search ..... 140/93 R, 93.2, 140/93.4; 254/216; 100/32

(56) References Cited

U.S. PATENT DOCUMENTS 3,284,049 A * 11/1966 Haraden ..... 140/93.4
3,309,061 A * 3/1967 Plattner ..... 140/93.2
3,360,017 A * 12/1967 Vilcins ..... 140/93.4

* cited by examiner

*Primary Examiner*—Lowell A. Larson
(74) *Attorney, Agent, or Firm*—Schwartz & Weinrieb

(57) ABSTRACT

A hand strapping tool has a lower gripper member incorporated therein which comprises an upstanding or upwardly projecting lip portion or member which is integrally formed upon the upper surface portion of the lower gripper member at an elevational level above the upper crest portions of lower gripper member teeth so as to inherently define a space between the upwardly projecting teeth of the lower gripper member and the undersurface portion of the lower end portion of the overlapped end portions of the strapping material when the upper tensioning wheel is retracted away from its engaged position with the lower gripper member. In this manner, the hand strapping tool, and more particularly, the base member and the lower gripper member mounted thereon, can be easily and readily released and removed from its engaged position with the article or package being strapped as well as with respect to the overlapped end portions of the strapping material. Still further, should the lip portion of the lower gripper member become eroded or worn, the lower gripper member can be simply removed and replaced as a result of a friction fit mounting within the base member of the hand strapping tool.

26 Claims, 2 Drawing Sheets

GRIPPER PLUG FOR HAND STRAPPING TOOL

FIELD OF THE INVENTION

The present invention relates generally to hand strapping tools used to tension and seal overlapping end portions of strapping material which is disposed around articles or packages which are to be secured or bound by the strapping material, and more particularly to a new and improved gripper plug which is to be used in conjunction with the tensioning wheel of the hand strapping tool so as to provide the overlapped end portions of the strapping material with the requisite amount of tension and yet facilitate the removal of the hand strapping tool from its engaged position with respect to the overlapped end portions of the strapping material once the overlapped end portions have in fact been tensioned and sealed by the hand strapping tool.

BACKGROUND OF THE INVENTION

Hand strapping tools for tensioning and sealing overlapping end portions of strapping material which is to be disposed around articles or packages which are to be secured or bound by the strapping material are of well known. A typical PRIOR ART hand strapping tool of the aforenoted type, that is, a hand strapping tool which is to be used for tensioning and sealing overlapping end portions of strapping material to be disposed around articles or packages which are to be secured or bound by the strapping material, is partially schematically disclosed within FIG. 1 and is generally indicated by the reference character 10.

More particularly, a package or article to be secured or bound by strapping material in the well-known manner is disclosed at 12, and the strapping material is disclosed at 14. Strapping material 14 is disposed around the article or package 12 so as to encircle the same, and accordingly, overlapped end portions 16,18 of the strapping material 14 are disposed, for example, above and in a spaced relationship with respect to the upper surface 20 of the package or article 12. The hand strapping tool 10 comprises a base member 22 which is adapted to be seated, for example, upon the upper surface 20 of the package or article 12 so as to in effect be interposed between the upper surface 20 of the package or article 12 and the overlapped end portions 16,18 of the strapping material 14, and the base member 22 is fixedly provided with an upwardly projecting lower punch or sealing die assembly 24 which is therefore adapted to engage the undersurface portion of the lower one of the overlapped end portions 16,18 of the strapping material 14. A plurality of vertically movable, upper punch or sealing die members 26 are disposed above the upper surface portion of the upper one of the overlapped end portions 16,18 of the strapping material 14, and accordingly, when the overlapped end portions 16,18 of the strapping material 14 have been properly or sufficiently tensioned with respect to each other, the upper punch or die members 26 are moved downwardly into engagement with the overlapped end portions 16,18 of the strapping material 14 whereby as a result of the operative cooperation defined between the upper punch or die members 26 and the lower punch or sealing die assembly 24, the overlapped end portions 16,18 of the strapping material 14 are secured or sealed together, for example, in a suitable crimped manner.

In order to achieve the aforenoted proper or sufficient tensioning of the overlapped end portions 16,18 of the strapping material 14, the hand strapping tool 10 further comprises a lower gripper member 28 which is also fixedly mounted upon the base member 22 and is adapted to be disposed beneath the lower one of the overlapped end portions 16,18 of the strapping material 14 when the base member 22 is inserted between the upper surface portion 20 of the package or article 12 and the overlapped end portions 16,18 of the strapping material 14. In addition, an upper, vertically movable rotatable tensioning wheel 30 is disposed above the upper one of the overlapped end portions 16,18 of the strapping material 14, and consequently, when the overlapped end portions 16,18 of the strapping material 14 are to be tightly or appropriately tensioned with respect to the article or package 12, upper tensioning wheel 30 is moved downwardly in order to operatively engage the overlapped end portions 16,18 of the strapping material 14 and cooperate with the fixed lower gripper member 28 by effectively gripping or engaging the overlapped end portions 16,18 of the strapping material 14 therebetween. Both the lower gripper member 28 and the upper tensioning wheel 30 are respectively provided with suitable gripping teeth 32,34, and accordingly, upon rotation of the tensioning wheel 30 in the counter-clockwise (CCW) direction, the gripping teeth 32,34 of the lower gripper member 28 and the upper tensioning wheel 30 engage the respective overlapped end portions 16,18 of the strapping material 14 and cause the overlapped end portions 16,18 of the strapping material 14 to be suitably tightened and tensioned with respect to each other, whereupon the upper and lower punch or sealing die members or components 26, 24 can then be actuated in the aforenoted manner with respect to each other so as to in fact achieve the aforenoted crimped securing or sealing of the overlapped end portions 16,18 of the strapping material 14. Upon completion of the securing or sealing operation performed upon the overlapped end portions 16,18 of the strapping material 14, the upper punch or die members 26 and the upper tensioning wheel 30 can be moved back or returned to their upper retracted positions whereupon the hand strapping tool 10 can then be removed from the strapped or bound article or package 12.

While the aforenoted hand strapping tool 10 has of course been generally or substantially satisfactory in connection with its service or performance of the tensioning or tightening, and subsequent securing or sealing, of strapping material 14 upon articles or packages 12, it has in fact been discovered or experienced, however, that such conventional hand strapping tools 10 do have operative drawbacks or disadvantages. For example, in view of the fact that the overlapped end portions 16,18 of the strapping material 14 are tightly engaged or tensioned around the package or article 12, and therefore, more particularly, in view of the fact that the overlapped end portions 16,18 of the strapping material 14 are similarly tightly engaged with the lower punch or sealing die assembly 24 as well as with the lower gripper member 28, it is often difficult to readily remove the hand strapping tool 10 from its operatively engaged position with respect to the article or package 12 and the overlapped end portions 16,18 of the strapping material 14.

In addition, each time the hand strapping tool 10 is in fact removed from an operatively engaged position with respect to an article or package 12 and its associated overlapped end portions 16, 18 of strapping material 14, relative sliding movement, under highly tightened or tensioned conditions, occurs between the undersurface portion of the lower overlapped end portion 16 of the strapping material 14 and the upper surfaces of the lower gripper member teeth 32. Accordingly, over a relatively short period of time wherein the hand strapping tool 10 is employed during operative cycles for tensioning and sealing overlapped end portions 16,18 of strapping material 14 around packages or articles 12, the upper gripping or biting surfaces of the lower gripper member teeth 32 tend to become dulled thereby decreasing their gripping or biting ability or function and thus necessitating frequent replacement of the lower gripper member 28 in order to properly maintain the tensioning or tightening functions of the lower gripper member 28 with respect to the lower end portion 16 of the overlapped end portions 16,18 and in operative conjunction with the upper tensioning wheel 30.

In order to overcome the various operational disadvantages or drawbacks characteristic of the conventional PRIOR ART hand strapping tool 10 disclosed within FIG. 1, a second improved conventional PRIOR ART hand strapping tool was developed and implemented, and this improved conventional PRIOR ART hand strapping tool is partially schematically disclosed within FIG. 2 and is generally indicated by the reference character 110. It is to be noted that a detailed description of the hand strapping tool 110 and its operative interaction with the overlapped end portions of the strapping material will not be set forth herein in view of the fact that such would simply be redundant and unnecessary because the basic tensioning and sealing operations of the two hand strapping tools 10,110 with respect to the overlapped end portions of the strapping material are substantially the same, and accordingly, only a description of the structural differences between the two hand strapping tools 10,110 will be set forth. In addition, it is also noted that corresponding parts of the hand strapping tool and the overlapped end portions of the strapping material will be designated by corresponding reference characters except that the reference characters in connection with the second conventional PRIOR ART hand strapping tool 110 will be within the 100 series.

More particularly, then, in order to overcome the various operational disadvantages or drawbacks characteristic of the conventional PRIOR ART hand strapping tool 10 disclosed within FIG. 1, the second improved conventional PRIOR ART hand strapping tool 110 is seen to comprise a base member 122 wherein one side or end portion of the base member 122 comprises an integrally formed, upwardly projecting lip member 136 wherein the uppermost crest portion 138 of the lip member 136 is adapted to be disposed slightly above the upper crest portions or extent of the lower gripper member teeth 132. As a result of the provision of such structure upon the base member 122, that is, in particular, to reiterate, as a result of the uppermost crest portion 138 of the lip member 136 being disposed slightly above the upper crest portions or extent of the lower gripper member teeth 132, it can readily be appreciated that those regions of the overlapped end portions 116,118 of the strapping material 114 which are disposed immediately adjacent to the upwardly projecting lip member 136 and which are disposed above the lower gripper member 128 will in effect be slightly spaced above the lower gripper member 128.

Accordingly, when the upper tensioning wheel 130 is lowered or moved downwardly so as to engage the overlapped end portions 116,118 of the strapping material 114 and to cooperatively engage the lower gripper member 128, those regions of the overlapped end portions 116,118 of the strapping material 114 which are disposed immediately adjacent to the upwardly projecting lip member 136 and which are disposed above the lower gripper member 128 will in effect be deflected slightly downwardly by means of the downwardly moving upper tensioning wheel 130 until those regions of the overlapped end portions 116,118 of the strapping material 114 engage the lower gripper member 128. Upon completion of the tensioning operation performed upon the overlapped end portions 116,118 of the strapping material 114, the upper tensioning wheel 130 is of course retracted or moved upwardly so as to return to its non-engagement position with respect to the overlapped end portions 116,118 of the strapping material 114 and the lower gripper member 128, and accordingly, again, due to the relative elevated disposition of the uppermost crest portion 138 of the lip member 136 with respect to the upper crest portions or extent of the lower gripper member teeth 132, those portions of the overlapped end portions 116,118 which are disposed adjacent to the lip member 136 and which were engaged between the upper tensioning wheel 130 and the lower gripper member 128 will likewise deflect slightly upwardly and thereby return to their original positions which were slightly spaced above the upper crest portions of the lower gripper member teeth 132.

Therefore, when the hand strapping tool 110 is to be removed from its operative position with respect to the package or article 112 and the overlapped end portions 116, 118 of the strapping material 114, the slight space defined between the undersurface of the lower one of the overlapped end portions 116,118 of the strapping material 114 and the upper surface or crest portions of the lower gripper member 128 will permit the hand strapping tool 110 to be more easily or readily removed from its engagement with the package or article 112 and the overlapped end portions 116,118 of the strapping material 114. However, even though the aforenoted structure facilitates the easier withdrawal of the hand strapping tool 110 from its engaged position with the package or article 112, it has been further discovered or experienced that due to the relatively high tightened or tensioned state of the strapping material 114 encircled around the package or article 112, and in particular, due to such relatively high tightened or tensioned state of the strapping material 114 engaged around the uppermost crest portion 138 of the lip member 136, the uppermost crest portion 138 of the lip member 136 will experience wear or erosion over time due to the relative repetitive sliding of the uppermost crest portion 138 with respect to the lower one of the overlapped end portions 116,118 of the strapping material 114 attendant multiple strapping operations performed by the hand strapping tool 110. Accordingly, over time, the elevational level of the uppermost crest portion 138 of the lip member 136 with respect to the elevational level of the upper crest portions of the teeth 132 of the lower gripper member 128 will in effect be lowered or reduced whereby a space will no longer be effectively defined between the undersurface portion of the lower one of the overlapped end portions 116,118 of the strapping material 114 and the lower gripper member teeth 132. Accordingly, the objective of having provided the upwardly projecting lip member 136 will in effect have been defeated. Under these circumstances, the upwardly projecting lip member 136 will have to be replaced, however, in view of the fact that the upwardly projecting lip member 136 is integral with the base member 122 of the hand strapping tool 110, the entire base member 122 must be replaced. This, however, entails a time-consuming and costly procedure.

A need therefore exists in the art for a new and improved hand strapping tool wherein the hand strapping tool can be in effect easily and readily removed from its engaged position with respect to the article or package being strapped as well as with respect to the tensioned overlapped end portions of the strapping material, while in effect also reducing or minimizing maintenance or replacement costs of the hand strapping tool components due to erosion or wear over time attendant the repetitive tensioning and sealing operations performed in connection with the tensioning and sealing of overlapped end portions of the strapping material.

OBJECTS OF THE INVENTION

Accordingly, it is an object of the present invention to provide a new and improved hand strapping tool.

Another object of the present invention is to provide a new and improved hand strapping tool wherein the hand strapping tool can be easily and readily removed from its engagement with respect to the article or package being strapped as well as with respect to the overlapped end portions of the tensioned strapping disposed about the article or package.

An additional object of the present invention is to provide a new and improved hand strapping tool wherein the hand strapping tool can be easily and readily removed from its engagement with respect to the article or package being strapped as well as with respect to the overlapped end portions of the tensioned strapping disposed about the article or package as a result of the provision of an upstanding lip member which creates or defines a space between the overlapped end portions of the tensioned strapping and the lower gripper member.

A further object of the present invention is to provide a new and improved hand strapping tool wherein the hand strapping tool can be easily and readily removed from its engagement with respect to the article or package being strapped as well as with respect to the overlapped end portions of the tensioned strapping disposed about the article or package as a result of the provision of an upstanding lip member which is integrally formed or provided upon the lower gripper member so as to create or define a space between the overlapped end portions of the tensioned strapping and the lower gripper member and which therefore also minimizes or reduces maintenance or replacement costs in view of the fact that if the upstanding lip member requirements replacement due to erosion attendant repetitive tensioning operations, only the lower gripper member needs to be replaced.

SUMMARY OF THE INVENTION

The foregoing and other objectives are achieved in accordance with the teachings and principles of the present invention through the provision of a new and improved hand strapping tool which comprises the incorporation therein of a lower gripper member wherein the lower gripper member is provided with an integral upwardly projecting lip portion. The upper surface of the upwardly projecting lip portion is disposed at an elevational level which is slightly above the elevational level of the upper crest portions of the teeth of the lower gripper member such that when the tensioning wheel is retracted upwardly back to its original inoperative position with respect to the lower gripper member, the upper surface of the upwardly projecting lip portion of the lower gripper member causes the overlapped end portions of the strapping material to be disposed slightly above the upper crest portions of the lower gripper member teeth. In this manner, the hand strapping tool can be readily removed relatively easily with respect to the package or article, and with respect to the tensioned overlapped end portions of the strapping material. In addition, should the upwardly projecting lip portion become worn due to erosion attendant repetitive tensioning operations and the relative sliding movement between the hand strapping tool and the tensioned overlapped end portions of the strapping material upon the conclusion of each strap tensioning operation, only the lower gripper member, and not the entire base member, needs to be replaced.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
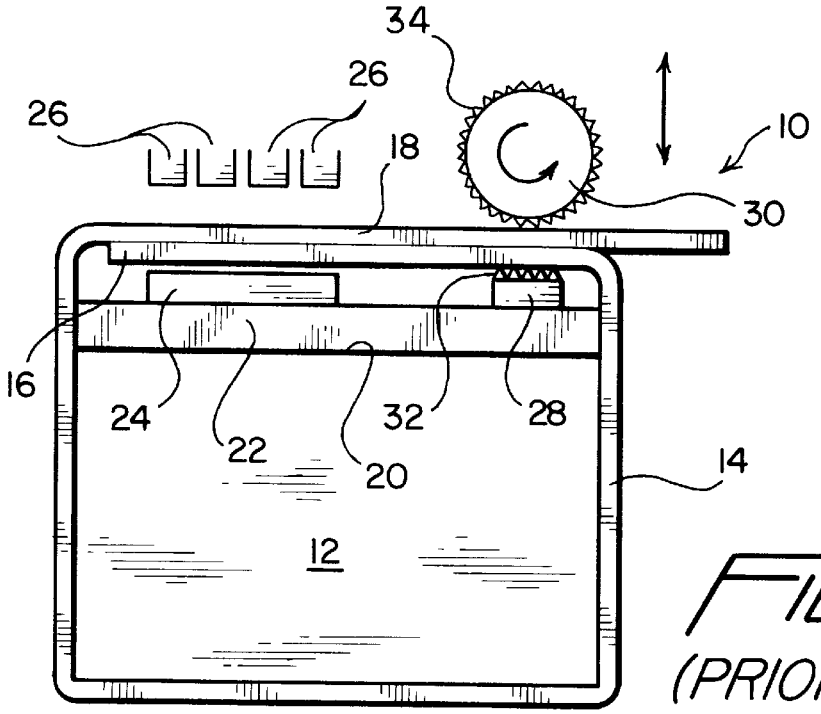
FIG. 1 (PRIOR ART)
FIG. 1 is a schematic side elevational view showing the use of a first PRIOR ART hand strapping tool which is used to tension overlapped end portions of strapping material which is to be disposed about a package or article.
Figure 2:
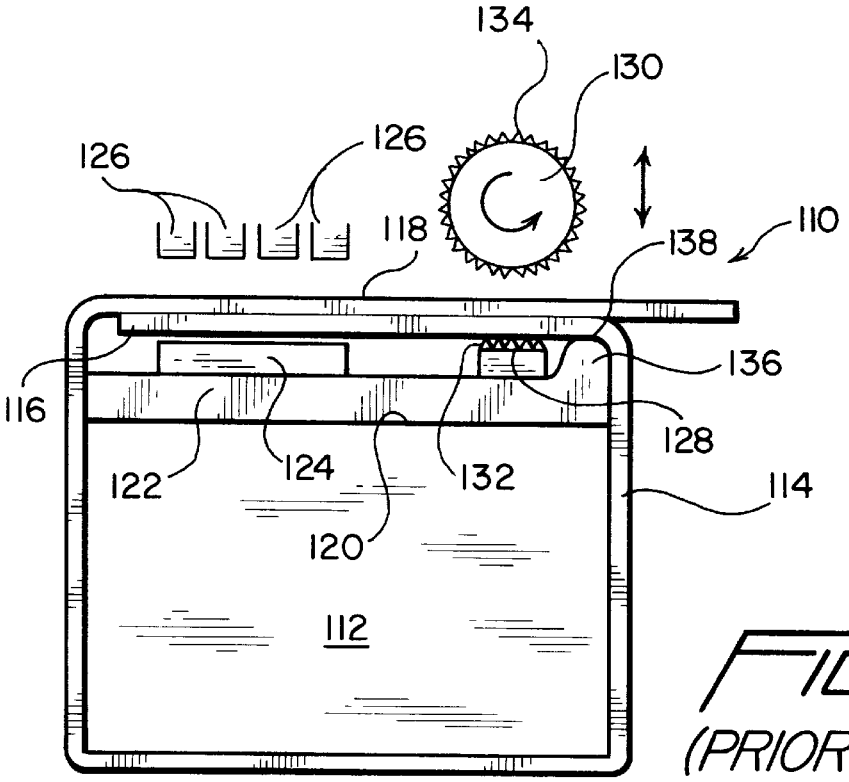
FIG. 2 (PRIOR ART)
FIG. 2 is a schematic side elevational view similar to that of FIG. 1 showing, however, the use of a second PRIOR ART hand strapping tool which is used to tension overlapped end portions of strapping material which is to be disposed about a package or article.

Referring now to the drawings, and more particularly to FIGS. 3–6 thereof, the new and improved hand strapping tool constructed in accordance with the principles and teachings of the present invention is disclosed and is generally indicated by the reference character 210. It is to be noted that the new and improved hand strapping tool constructed in accordance with the principles and teachings of the present invention is essentially similar in overall operation to that of the PRIOR ART hand strapping tools 10 and 110 respectively disclosed within FIGS. 1 and 2, and consequently, in the interest of brevity, those component parts of the new and improved hand strapping tool 210 which correspond to component parts of the PRIOR ART hand strapping tools 10 and 110 of FIGS. 1 and 2 will be designated by corresponding reference characters, however, such corresponding component parts will not be described in detail as such a detailed description is not necessary with respect to a full and complete understanding of the present invention. To the contrary, those component parts of the new and improved hand strapping tool 210 of the present invention which differ from the component parts of the PRIOR ART hand strapping tools 10 and 110 disclosed within FIGS. 1 and 2 will be described in detail in order to fully and completely disclose the structural details and operation of the new and improved hand strapping tool 210 of the present invention.

More particularly, then, a package or article, to be secured by means of tensioned strapping material 214 which is encircled around the package or article, is disclosed at 212, with the lower punch or sealing die assembly 224 and the plurality of vertically movable upper punch or sealing die members 226 also being disclosed for achieving the securing or sealing operations upon the overlapped end portions 216,218. In order to achieve such tensioned state of the overlapped end portions 216,218 of the strapping material 214, the new and improved hand strapping tool 210 of the present invention is seen to further comprise an upper tensioning wheel 230, and more particularly, the new and improved lower gripper member 228 which, along with the lower punch or sealing die assembly 224, is mounted upon the hand strapping tool base member 222. The upper tensioning wheel 230 has teeth components 234 disposed in annular array around its external periphery, and the lower gripper member 228 is provided with a plurality of gripper teeth 248. Other than the aforenoted structure of the lower gripper member 228, however, the structural features, components, or characteristics of the new and improved lower gripper member 228 of the present invention render the new and improved lower gripper member 228 of the present invention quite different from the lower gripper members 28 and 128.

Figure 4:
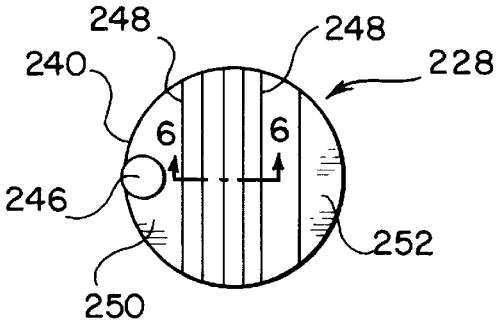
FIG. 4 is a top plan view of a first embodiment of a new and improved lower gripper member which is constructed in accordance with the principles and teachings of the present invention and which may be incorporated within the new and improved hand strapping tool disclosed within FIG. 3.
Figure 5:
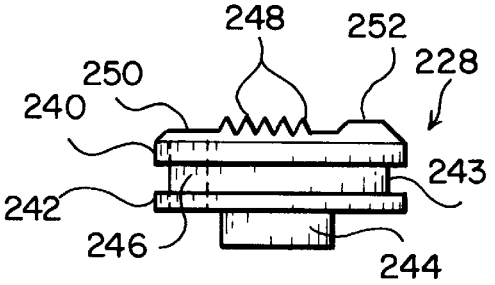
FIG. 5 is a side elevational view of the first embodiment of the new and improved lower gripper member of the present invention as disclosed within FIG. 4.
Figure 6:
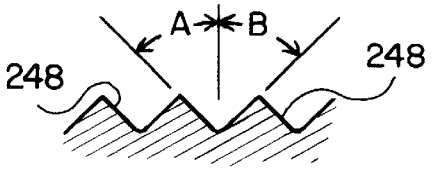
FIG. 6 is a partial cross-sectional view of the first embodiment of the new and improved lower gripper member disclosed within FIG. 4 as taken along the lines 6—6 of FIG. 4.

With particular reference then being made to FIGS. 4–6, a first embodiment of a new and improved lower gripper member 228 constructed in accordance with the principles and teachings of the present invention is disclosed and it is seen the lower gripper member 228 comprises in effect a body member which has the form of a circular plug. The lower gripper member 228 comprises upper and lower vertically spaced flanged portions 240,242, and the lower flanged portion 242 is provided with a dependent cylindrical stem or plug base 244 which is adapted to be disposed or fitted within an aperture, not shown, defined within the base member 222 of the hand strapping tool 210. The lower gripper member 228 is also provided with a vertical through-bore 246 and the base member 222 is provided with an upstanding post or pin, not shown, which is adapted to be inserted within the through-bore 246 of the lower gripper member 228 whereby the lower gripper member 228 is mounted and properly circumferentially oriented upon the base member 222. In order to fixedly retain the lower gripper member 228 in its mounted position upon the base member 222, the lower flanged portion 242 is adapted to be disposed within an aperture, not shown, provided within the base member 222, and an O-ring sealing member, also not shown, is adapted to be disposed around the radially recessed portion 243 of the lower gripper member 228 so as to be interposed between the upper and lower flanged portions 240,242 and to engage the aperture, not shown, of the base member 222 in a friction or compressed fit manner. The upper flanged portion 240 of the lower gripper member 228 is also seen to further comprise a plurality, for example, five (5), of diametrically oriented gripper tensioning teeth 248 disposed parallel to each other, and it is seen that the upper crest portions of the gripper tensioning teeth 248 are disposed at a predetermined elevational level above a first plateau portion 250.

In this manner, when the vertically movable upper tensioning wheel 230 is lowered so as to operatively cooperate with the lower gripper member 228, with the overlapped end portions 216,218 of the strapping material 214 interposed therebetween, the annular array of teeth 234 disposed upon the outer periphery of the upper tensioning wheel 230 can properly engage the upper overlapped end portion 218 while the upwardly projecting teeth 248 of the lower gripper member 228 engage the lower overlapped end portion 216 whereby the upper tensioning wheel 230 and the lower gripper member 228 will together properly tension the overlapped end portions 216,218 of the strapping material 214. As further seen in FIG. 6, each one of the lower gripper member teeth 248 has a left side flank portion which is disposed, for example, at an angle A of approximately 52.50° with respect to a vertical plane, while a right side flank portion is disposed, for example, at an angle B of approximately 37.5° with respect to the vertical plane. The difference in the noted angular orientations of the teeth flank portions with respect to the vertical plane is such that, for example, the left side flank portion disposed at the greater angle with respect to the vertical plane provides enhanced biting engagement with respect to the lower overlapped end portion 216 of the strapping material 214 during the tensioning operation.

Figure 3:
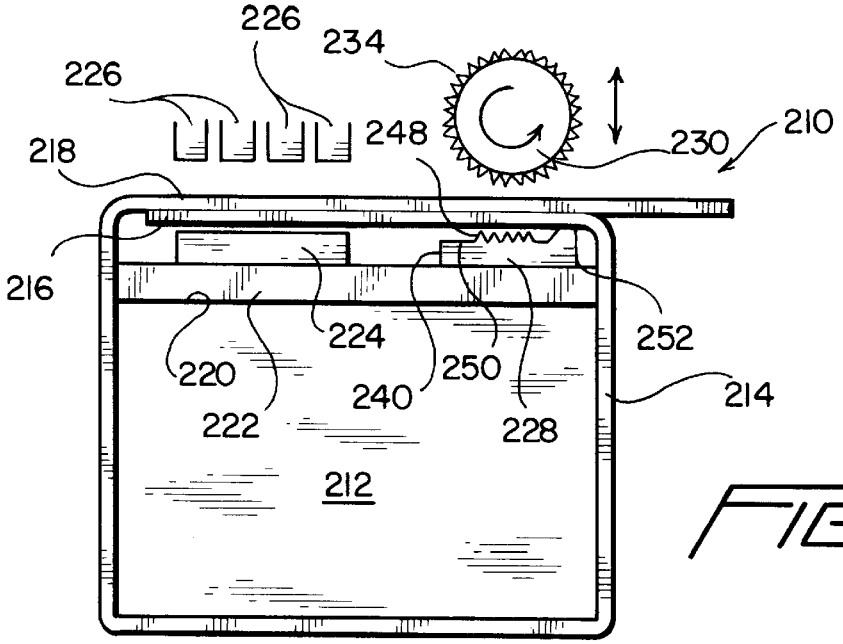
FIG. 3 is a schematic side elevational view similar to that of FIGS. 1 and 2 showing, however, the use of a new and improved hand strapping tool constructed in accordance with the principles and teachings of the present invention for tensioning overlapped end portions of strapping material which is to be disposed about a package or article.

In accordance with a unique feature characteristic of the new and improved gripper plug 228 constructed in accordance with the principles and teachings of the present invention, an upwardly projecting second plateau portion 252, having a segmented geometrical configuration, is defined upon the upper flanged portion 240. More particularly, an upper planar surface of the second plateau portion 252 is disposed at an elevational level which is slightly above the elevational level of the crest portions of the lower gripper member teeth 248 wherein, for example, the elevational level difference between the upper planar surface of second plateau portion 252 and the crest portions of the lower gripper member teeth 248 is on the order of 0.005–0.008 inches. In this manner, as may best be appreciated from FIG. 3 when the lower gripper member 228 is mounted upon the base member 222 of the hand strapping tool 210 so as to be operatively incorporated within the hand strapping tool 210, the second plateau portion 252 effectively defines a lip portion or member around which the lower end portion 216 of the overlapped end portions 216,218 of the strapping material 214 is disposed or engaged. Consequently, when the upper tensioning wheel 230 is moved back to its normally retracted inoperative position as shown in FIG. 3, and due to the aforenoted disposition of the lower end portion 216 of the overlapped end portions 216,218 of the strapping material 214 in engagement with or around the lip member of the second plateau portion 252, a slight space will be defined between the upper crest portions of the lower gripper member teeth 248 and the undersurface region of the lower end portion 216 of the overlapped end portions 216,218 of the strapping material 214.

Accordingly, when the hand strapping tool 210 is to be removed from its engaged position with the overlapped end portions 216,218 of the strapping material 214, as well as with the upper surface portion 220 of the article or package 212, upon completion of a strap tensioning and sealing operation with respect to the article or package 212, the aforenoted space defined between the upper crest portions of the lower gripper member teeth 248 and the undersurface region of the lower end portion 216 of the overlapped end portions 216,218 of the strapping material 214 will in fact permit the hand strapping tool 210 to be readily or relatively easily removed. Still further, it is also to be appreciated that should the lip member of the second plateau portion 252 of the lower gripper member 228 become worn or eroded over time as a result of multiple strap tensioning operations and the relative movement defined between the lower end portion 216 of the overlapped end portions 216,218 of the strapping material 214 and the lip member of the second plateau portion 252 attendant repetitive withdrawal or removal of the hand strapping tool 210 from its engagement with the overlapped end portions 216,218 of the strapping material 214 as well as with the package or article 212 under the aforenoted tensioned conditions or state, replacement of the lip member of the second plateau portion 252 of the lower gripper member 228 is simply and quickly rectified simply by replacing the lower gripper plug member 228 as a result of its aforenoted friction fit within the base member 228.

Figure 7:
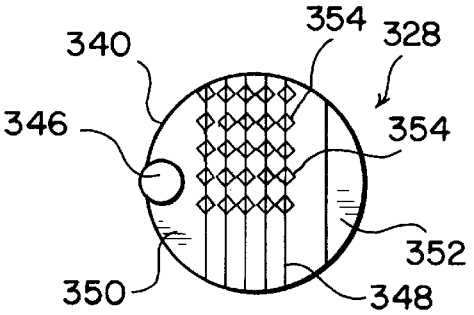
FIG. 7 is a top plan view similar to that of FIG. 4 showing, however, a second embodiment of a new and improved lower gripper member which is constructed in accordance with the principles and teachings of the present invention and which, similar to the first embodiment of the new and improved lower gripper member disclosed within FIG. 4, may likewise be incorporated within the new and improved hand strapping tool disclosed within FIG. 3.

With reference lastly being made to FIG. 7, there is disclosed a second embodiment of a new and improved lower gripper member which is constructed in accordance with the principles and teachings of the present invention and which is generally indicated by the reference character 328. The second embodiment lower gripper member 328 is identical in all respects to the first embodiment lower gripper member 228, with one exception as will be noted shortly hereinafter, and accordingly, all component parts or features of the second embodiment lower gripper member 328 which correspond to similar component parts or features of the first embodiment lower gripper member 228 are designated by similar reference characters except that the reference characters for the second embodiment lower gripper member 328 are in the 300 series. The only structural difference between the two lower gripper members 228,328 resides in the fact that in addition to the provision of the upwardly projecting teeth 348, which correspond to the upwardly projecting teeth 248 of the first embodiment lower gripper member 228, each one of the upwardly projecting teeth 348 of the second embodiment lower gripper member 328 is also provided with a plurality of notches which, in effect, form or define diamond-shaped toothed facets 354. It is to be appreciated that since the diamond-shaped toothed facets 354 are defined in a longitudinal array upon each one of the diametrically oriented upwardly projecting teeth 348, and are also defined in lateral or transversely disposed arrays as a result of being disposed adjacent to each other upon adjacent ones of the upwardly projecting teeth 348, the diamond-shaped toothed facets 354 are collectively arranged in a uniform grid-type pattern of rows and columns and therefore define toothed surfaces which are oriented in both the diametrical and transverse directions so as to present additional engagement surfaces for enhanced engagement or friction with respect to the undersurface portions of the lower end portion 216 of the overlapped end portions 216,218 of the strapping material 214 when the overlapped end portions 216,218 of the strapping material 214 are to be tensioned.

It is lastly to be noted that the notches defining the diamond-shaped toothed facets 354 are formed or provided upon only substantially one diametrical half of the plurality of teeth 348, and the reason for this is that when the overlapped end portions 216,218 of the strapping material 214 are conducted along their paths into the hand strapping tool 210, the undersurface portion of the lower overlapped end portion 216 of the strapping material 214 will engage only the one diametrical half of the lower gripper member 328 upon which the diamond-shaped toothed facets 354 are provided or defined.

Thus, it may be seen that in accordance with the principles and teachings of the present invention, a new and improved hand strapping tool, having a new and improved lower gripper member incorporated therein, has been developed whereby an upstanding or upwardly projecting lip portion or member is integrally formed upon the upper surface portion of the lower gripper member at an elevational level above the upper crest portions of the lower gripper member teeth so as to inherently define a space between the upwardly projecting teeth of the lower gripper member and the undersurface portion of the lower end portion of the overlapped end portions of the strapping material when the upper tensioning wheel is retracted away from its engaged position with the lower gripper member. In this manner, the hand strapping tool, and more particularly, the base member and the lower gripper member mounted thereon, can be easily and readily released and removed from its engaged position with the article or package being strapped as well as with respect to the overlapped end portions of the strapping material. Still further, should the lip portion of the lower gripper member become eroded or worn, the lower gripper member can be simply removed and replaced as a result of its friction fit within the base member of the hand strapping tool.

Obviously, many variations and modifications of the present invention are possible in light of the above teachings. It is therefore to be understood that within the scope of the appended claims, the present invention may be practiced otherwise than as specifically described herein.

What is claim as new and desired to be protected by Letters Patent of the United States of America, is:

1. A gripper member for cooperative engagement with a second gripper member within a hand strapping tool used for tensioning and sealing a pair of overlapped end portions of strapping material disposed about an article to be strapped, comprising:

a body member;

a plurality of teeth provided upon said body member for engaging one of the pair of overlapped end portions of the strapping material disposed about the article to be strapped; and a lip member mounted upon said body member of said gripper member wherein an upper surface portion of said lip member is disposed slightly above uppermost portions of said plurality of teeth provided upon said body member for defining a space between the one of the pair of overlapped end portions of the strapping material and the uppermost portions of said plurality of teeth, when the second gripper member is disposed at an inoperative position with respect to said gripper member, so as to facilitate the disengagement and removal of the hand strapping tool from engagement with the tensioned pair of overlapped end portions of strapping material and the article being strapped.

2. The gripper member as set forth in claim 1, wherein:

said gripper member comprises a circular plug.

3. The gripper member as set forth in claim 1, wherein:

said plurality of teeth provided upon said body member comprise five diametrically oriented teeth disposed parallel to each other.

4. The gripper member as set forth in claim 1, wherein:

said lip member comprises an elevated plateau portion having a segmental geometrical configuration.

5. The gripper member as set forth in claim 1, wherein:

said body member comprises a pair of vertically spaced annular flanged portions having a radially recessed portion defined therebetween for receiving an O-ring sealing member for disposition within a bore of the hand strapping tool by means of which said body member is removably mounted upon the hand strapping tool by means of a friction fit.

6. The gripper member as set forth in claim 1, wherein:

said uppermost portions of said plurality of teeth comprise crest portions; and said upper surface portion of said lip member comprises a planar surface which is disposed above said crest portions of said plurality of teeth by means of a dimension which is within the range of 0.005–0.008 inches.

7. The gripper member as set forth in claim 1, further comprising:

a plurality of notches formed upon each one of said plurality of teeth of said body member so as to form a plurality of multi-faceted toothed surfaces upon each one of said plurality of teeth of said body member.

8. The gripper member as set forth in claim 7, wherein:

each one of said plurality of notches has a substantially diamond-shaped configuration.

9. The gripper member as set forth in claim 7, wherein:

said plurality of notches are arranged within a grid pattern upon said plurality of teeth of said gripper member.

10. The gripper member as set forth in claim 9, wherein:

said grid pattern of said plurality of notches comprises rows and columns within which said plurality of notches are uniformly arranged.

11. The gripper member as set forth in claim 1, further comprising:

a through-bore defined within said body member for receiving a pin of the hand strapping tool so as to properly circumferentially orient said body member upon the hand strapping tool.

12. The gripper member as set forth in claim 1, wherein:

each one of said plurality of teeth comprises a left side flank portion and a right side flank portion with a first one of said flank portions being disposed at a greater angle with respect to a vertical plane than a second one of said flank portions so as to enhance the biting engagement of said teeth with respect to the one of the pair of overlapped end portions of the strapping material.

13. The gripper member as set forth in claim 12, wherein:

said left side flank portion is disposed at an angle of approximately 52.5° with respect to said vertical plane; and said right side flank portion is disposed at an angle of approximately 37.5° with respect to said vertical plane.

14. A hand strapping tool for tensioning and sealing a pair of overlapped end portions of strapping material disposed about an article to be strapped, comprising:

a base member;

an upper tensioning wheel movable toward and away from overlapped end portions of strapping material to be tensioned in preparation for a strapping material sealing operation; and a lower gripper member comprising a body member mounted upon said base member; a plurality of teeth provided upon said body member for engaging one of the pair of overlapped end portions of the strapping material disposed about the article to be strapped and for cooperating with said upper tensioning wheel for tensioning the overlapped end portions of the strapping material; and a lip member mounted upon said body member of said lower gripper member wherein an upper surface portion of said lip member is disposed slightly above uppermost portions of said plurality of teeth provided upon said body member for defining a space between the one of the pair of overlapped end portions of the strapping material and said uppermost portions of said plurality of teeth, when said upper tensioning wheel is disposed at an inoperative position with respect to said lower gripper member, so as to facilitate the disengagement and removal of said hand strapping tool from engagement with the tensioned pair of overlapped end portions of strapping material and the article being strapped.

15. The hand strapping tool as set forth in claim 14, wherein:

said gripper member comprises a circular plug.

16. The hand strapping tool as set forth in claim 14, wherein:

said plurality of teeth provided upon said body member comprise five diametrically oriented teeth disposed parallel to each other.

17. The hand strapping tool as set forth in claim 14, wherein:

said lip member comprises an elevated plateau portion having a segmental geometrical configuration.

18. The hand strapping tool as set forth in claim 14, wherein:

said body member comprises a pair of vertically spaced annular flanged portions having a radially recessed portion defined therebetween for receiving an O-ring sealing member for disposition within a bore of said hand strapping tool by means of which said body member is removably mounted upon the hand strapping tool by means of a friction fit.

19. The hand strapping tool as set forth in claim 14, wherein:

said uppermost portions of said plurality of teeth comprise crest portions; and said upper surface portion of said lip member comprises a planar surface which is disposed above said crest portions of said plurality of teeth by means of a dimension which is within the range of 0.005–0.008 inches.

20. The hand strapping tool as set forth in claim 14, further comprising:

a plurality of notches formed upon each one of said plurality of teeth of said body member so as to form a plurality of multi-faceted toothed surfaces upon each one of said plurality of teeth of said body member.

21. The hand strapping tool as set forth in claim 20, wherein:

each one of said plurality of notches has a substantially diamond-shaped configuration.

22. The hand strapping tool as set forth in claim 20, wherein:

said plurality of notches are arranged within a grid pattern upon said plurality of teeth of said gripper member.

23. The hand strapping tool as set forth in claim 22, wherein:

said grid pattern of said plurality of notches comprises rows and columns within which said plurality of notches are uniformly arranged.

24. The hand strapping tool as set forth in claim 14, wherein:

a through-bore defined within said body member for receiving a pin of the hand strapping tool so as to properly circumferentially orient said body member upon the hand strapping tool.

25. The hand strapping tool as set forth in claim 14, wherein:

each one of said plurality of teeth of said gripper member comprises a left side flank portion and a right side flank portion with a first one of said flank portions being disposed at a greater angle with respect to a vertical plane than a second one of said flank portions so as to enhance the biting engagement of said teeth with respect to the one of the pair of overlapped end portions of the strapping material.

26. The hand strapping tool as set forth in claim 25, wherein:

said left side flank portion is disposed at an angle of approximately 52.5° with respect to said vertical plane; and said right side flank portion is disposed at an angle of approximately 37.5° with respect to said vertical plane.

* * * * *